United States Patent [19]

Mikami et al.

[11] Patent Number: 5,075,508

[45] Date of Patent: Dec. 24, 1991

[54] TRIPERFLUOROALKYLAMINES AND PREPARATION OF THE SAME

[75] Inventors: Kenji Mikami; Yoshio Iwai; Nobuyoshi Iwashita; Yasuhisa Furutaka, all of Osaka, Japan

[73] Assignee: Daikin Industries Ltd., Osaka, Japan

[21] Appl. No.: 381,951

[22] Filed: Jul. 19, 1989

Related U.S. Application Data

[62] Division of Ser. No. 154,220, Feb. 11, 1988, abandoned.

[30] Foreign Application Priority Data

Feb. 13, 1987 [JP] Japan ..... 62-31993

[51] Int. Cl.[5] ..... C07C 209/74

[52] U.S. Cl. ..... 564/496; 204/59 F; 564/510

[58] Field of Search ..... 564/496, 510; 204/59 F

[56] References Cited

U.S. PATENT DOCUMENTS 2,616,927 11/1952 Kauck et al. ..... 260/563
3,535,381 10/1970 Hauptschein et al. ..... 260/570.9
3,882,182 5/1975 Benninger et al. ..... 260/584 C

FOREIGN PATENT DOCUMENTS 0879057 2/1960 United Kingdom .
1210842 11/1970 United Kingdom .
1257184 12/1971 United Kingdom .

*Primary Examiner*—Glennon H. Hollrah
*Assistant Examiner*—Peter G. O'Sullivan
*Attorney, Agent, or Firm*—Birch, Stewart, Kolasch & Birch

[57] ABSTRACT

Triperfluoroalkylamines of the formula:

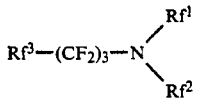

(I)

wherein, $Rf^1$ and $Rf^2$ are each a perfluoroalkyl group having 1 to 4 carbon atoms, and $Rf^3$ is a perfluoroalkyl group having 3 to 11 carbon atoms, have good thermal stability, good voltage resistance, good fluidity at low temperature and low surface energy and which produce no toxic perfluoroisobutene.

2 Claims, No Drawings

TRIPERFLUOROALKYLAMINES AND PREPARATION OF THE SAME

This application is a division of copending application Ser. No. 07/154,220 filed on Feb. 11, 1988, now abandoned.

BACKGROUND OF THE INVENTION

1. Field of the Invention

The present invention relates to triperfluoroalkylamines and preparation of the same.

2. Description of the Prior Arts

A triperfluoroalkylamine is used as a component of an artificial blood, an inspecting agent for integrated circuits, a heating medium for vapor-phase soldering, a solvent and the like since it has good properties such as (1) good chemical and thermal stability, (2) low surface energy and (3) low toxicity. However, conventional triperfluoroalkylamines have a disadvantage that they are easily pyrolyzed and generate toxic perfluoroisobutene.

Conventional methods for preparing the triperfluoroalkylamines include a method which comprises fluorinating a hydrocarbon tertiary amine with a fluorinating agent such as fluorine gas or cobalt fluoride (cf. U.S. Pat. No. 2,616,927, Journal of the American Chemical Society, 78, 1679 (1956) and Tetrahedron, 35, 2405 (1979)) and a method which comprises electrolytically fluorinating a hydrocarbon tertiary amine or a tertiary amine having a partially fluorinated alkyl group (cf. Journal of the Fluorine Chemistry, 27, 333 (1985)). In any of the conventional methods, a side reaction such as decomposition occurs and the triperfluoroalkylamine is produced in a low yield.

SUMMARY OF THE INVENTION

An object of the present invention is to provide a triperfluoroalkylamine which has good thermal stability and generates no toxic substance when pyrolyzed.

Another object of the present invention is to provide a method for producing such triperfluoroalkylamine in a high yield.

It has been found that when a specific tertiary amine having an alkyl group with a fluorine atom bonded to a carbon atom is electrolytically fluorinated, a triperfluoroalkylamine is produced in a high yield, has no problem as described above and good properties.

Accordingly, the present invention provides a triperfluoroalkylamine of the formula:

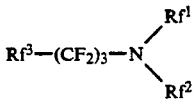

(I)

wherein, $Rf^1$ and $Rf^2$ are each and a perfluoroalkyl group having 1 to 4 carbon atoms, and $Rf^3$ is a perfluoroalkyl group having 3 to 11 carbon atoms.

It also provides a method for preparing a triperfluoroalkylamine of the formula (I) which comprises electrolytically fluorinating a fluorine-containing tertiary amine of the formula:

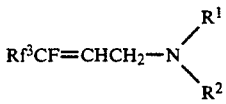

(II)

or a mixture of the fluorine-containing tertiary amine of the formula (II) and

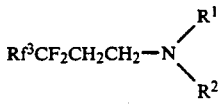

(III)

wherein, $R^1$ and $R^2$ are each an alkyl group having 1 to 4 carbon atoms, and $Rf^3$ is a fluoroalkyl group having 3 to 11 carbons.

DETAILED DESCRIPTION OF THE INVENTION

Examples of the triperfluoroalkylamine of the formula (I) according to the present invention are:

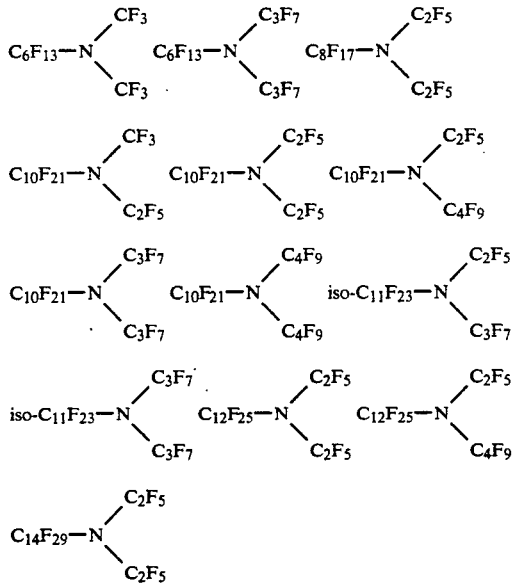

The fluorine-containing tertiary amine of the formula (II) or (III) which is used as a starting material in the process according to the present invention is per se known. Examples and preparation of the amines (II) and (III) are described in, for example, U.S. Pat. No. 3,535,381, the disclosure of which is incorporated herein by reference, and Japanese Patent Publication No. 35523/1970.

Preferred examples of the fluorine-containing tertiary amines to be used as the starting material are $C_3F_7CF{=}CHCH_2N(CH_3)_2$,
$C_3F_7CF{=}CHCH_2N(C_3H_7)_2$,
$C_5F_{11}CF{=}CHCH_2N(C_2H_3)_2$,
$C_5F_{11}CF_2CH_2CH_2N(C_2H_5)_2$,
$C_7F_{15}CF{=}CHCH_2N(C_2H_5)_2$,
$C_7F_{15}CF_2\ CH_2CH_2N(C_2H_5)_2$,
$C_7F_{15}CF{=}CHCH_2N(C_3H_1)_2$,
$C_7F_{15}CF{=}CHCH_2N(C_3H_7)_2$,
$C_7F_{15}CF{=}CHCH_2N(C_4H_9)_2$,
$C_7H_{15}CF{=}CHCH_2N(CHCH_2N(CH_3)C_2H_5$,
$C_7F_{15}CF{=}CHCH_2N(C_2H_5)C_4H_9$, $i\text{-}C_8H_{17}CF{=}CHCH_2N(C_2H_5)_2$,
$i\text{-}C_8F_{17}CF{=}CHCH_2N(C_3H_7)_2$,
$C_9H_{19}CF{=}CHCH_2N)C_2H_5)_2$,
$C_9F_{19}CF_2CH_2CH_2N(C_2H_5)_2$, and
$C_{11}F_{23}CF{=}CHCH_2N(C_2H_5)_2$.

In the process according to the present invention, reaction conditions such as the electrolysis voltage, an anode current density and an electrolysis temperature in the electrolytically fluorinating reaction may be the same as the conventional ones. Preferably, the electrolysis voltage is from 4 to 8 volts, the anode current density is from 0.1 to 5 A/dm$^2$ and the electrolysis temperature is from 0 to 30° C.

Hydrogen-containing compounds which remain in a crude product by the electrolytically fluorinating reaction can be separated from the triperfluoroalkylamine of the formula (I), since they form a separate phase from the triperfluoroalkylamine of the formula (I) when they are reacted with an organic or inorganic base (cf. Japanese Patent Kokai Publication No. 1484/1984).

The triperfluoroalkylamine of the formula (I) has good thermal stability, good voltage resistance, good fluidity at low temperature, low surface energy and the like. Therefore, it can be successfully used as a component of an artificial blood, an inspecting agent for integral circuits, a heating medium for vapor-phase soldering, a solvent and the like.

The triperfluoroalkylamine of the formula (I) have better thermal stability than a conventional triperfluoroalkylamine $(C_5F_{11})_3N$ which is often used as the heating medium for vapor-phase soldering. The reason for this is supposed to be that the amine of the present invention has an asymmetric structure around a central nitrogen atom. The triperfluoroalkylamine of the formula (I), when decomposed, does not generate toxic perfluoroisobutene although the conventional triperfluoroalkylamine does.

The process according to the present invention gives better yield than a conventional preparation process since the specific trialkylamine of formula (II) or (III) having fluorine atoms bonded to the carbon atom is used as a starting material.

The present invention will be hereinafter explained by following examples.

Example 1

A mixture of a starting material (50 g, 0.089 mol) and of the formula:

$C_7F_{15}CF{=}CHCH_2N(C_3H_7)_2$ and hydrogen fluoride (one liter) was charged in an electrolytic reactor which had three nickel electrode plates (anode area: 4 dm$^2$) positioned at intervals of 6 mm. The mixture was electrolyzed at a temperature of 5° to 15° C. for 16 hours at an anode current density of 1 to 3 A/dm$^2$ and a reactor voltage of 4 to 8 V. Hydrogen fluoride (each 10 ml) was added every 4 hours and an evaporated portion was refluxed with a reflux condenser.

After electrolysis, a crude product accumulated at the bottom of reactor was recovered and washed with water. Then, an aqueous solution (200 g) consisting of an 8 N aqueous potassium hydroxide solution (100 parts by weight) and dibutylamine (100 parts by weight) was added to the crude product and refluxed for 20 hours.

A triperfluoroalkylamine (42 g, 0.0482 mol) of the formula:

$C_{10}F_{21}N(C_3F_7)_2$ was obtained by rectification. Boiling point: 238° C., Yield, 54.3%

Example 2

A mixture of starting materials (250 g) consisting of 15% by weight of a compound of the formula:

$C_5F_{11}CF{=}CHCH_2N(C_2H_5)_2$

15% by weight of a compound of the formula:

$C_5F_{11}CF_2CH_2CH_2N(C_2H_5)_2$

28% by weight of a compound of the formula:

$C_7F_{15}CF{=}CHCH_2N(C_2H_5)$

12% by weight of a compound of the formula:

$C_7F_{15}CF_2CH_2CH_2N(C_2H_5)_2$

16% by weight of a compound of the formula:

$C_9F_{19}CF{=}CHCH_2N(C_2H_5)_2$

4% by weight of a compound of the formula:

$C_9F_{19}CF_2CH_2CH_2N(C_2H_5)_2$ and 10% by weight of a compound of the formula:

$C_{11}F_{23}CF{=}CHCH_2N(C_2H_5)_2$ and hydrogen fluoride (2 liters) was charged in an electrolytic reactor which had five nickel electrode plates positioned at intervals of 6 mm. The mixture was electrolyzed at a temperature of 10° to 18° C. for 30 hours at an anode current density of 1 to 3 A/dm$^2$ and a reactor voltage of 4 to 8 V. Hydrogen fluoride was added every 4 hours to maintain its amount constant.

After electrolysis, a crude product accumulated at the bottom of reactor was recovered and washed with water. Then, an aqueous solution (200 g) consisting of an 8 N aqueous potassium hydroxide solution (100 parts by weight) and dibutylamine (100 parts by weight) was added to the crude product and refluxed for 20 hours.

Triperfluoroalkylamines shown in Table 1 were obtained by rectification.

TABLE 1

| Triperfluoroalkylamine | Boiling point (°C.) | Yield grams (%) |
|---|---|---|
| $C_8F_{17}N(C_2F_5)_2$ | 180 | 62 g (49.5%) |
| $C_{10}F_{21}N(C_2F_5)_2$ | 213 | 85 g (54.8%) |
| $C_{12}F_{25}N(C_2F_5)_2$ | 234 | 42 g (57.3%) |
| $C_{14}F_{29}N(C_2F_5)_2$ | 269 | 20 g (56.7%) |

Examples 3 to 10

In the same manner as in Example 1 but using the compounds of the formula (II) having substituents $Rf^3$, $R^1$ and $R^2$ shown in Table 2 as the starting material, the electrolysis was carried out. Boiling points of resulting triperfluoroalkylamines are shown in Table 2.

TABLE 2

| Example No. | Starting material $Rf^3$ | $R^1$ | $R^2$ | Boiling point (°C.) |
|---|---|---|---|---|
| 3 | $C_3F_7$— | $CH_3$— | $CH_3$— | 108 |
| 4 | $C_3F_7$— | $C_3H_7$— | $C_3H_7$— | 185 |
| 5 | $C_7F_{15}$— | $C_3H_7$— | $C_3H_7$— | 236 |
| 6 | $C_7F_{15}$— | $C_4H_9$— | $C_4H_9$— | 258 |
| 7 | i—$C_8F_{17}$— | $C_2H_5$— | $C_2H_5$— | 219 |
| 8 | i—$C_8F_{17}$— | $C_3H_7$— | $C_3H_7$— | 247 |
| 9 | $C_7F_{15}$— | $CH_3$— | $C_2H_5$— | 195 |

TABLE 2-continued

| Example No. | Starting material $Rf^3$ | $R^1$ | $R^2$ | Boiling point (°C.) |
|---|---|---|---|---|
| 10 | $C_7F_{15}$— | $C_2H_5$— | $C_4H_9$— | 238 |

Experiments 1 to 10 and the comparative Experiment

The triperfluoroalkylamines prepared in Examples 1 to 10 (Experiments 1 to 10) and $(C_5F_{11})_3N$ (Comparative Experiment) were heated at its boiling temperature for 400 hours. Toxic perfluoroisobutene was not detected in Experiments 1 to 10, while it was detected in Comparative Experiment.

What is claimed is:

1. A method for preparing a triperfluoroalkylamine of the formula:

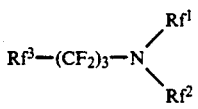

(I)

wherein $Rf^1$ and $Rf^2$ are each a perfluoroalkyl group having 1 to 4 carbon atoms, and $Rf^3$ is a perfluoroalkyl group having 3 to 11 carbon atoms, which comprises electrolytically fluorinating a fluorine-containing tertiary amine of the formula:

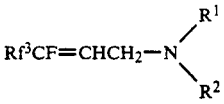

(II)

or a mixture of the fluorine-containing tertiary amine of the formula (II) and

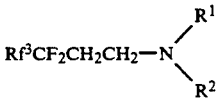

(III)

wherein $R^1$ and $R^2$ are each an alkyl group having 1 to 4 carbon atoms, and $Rf^3$ is a fluoroalkyl group having 3 to 11 carbon atoms.

2. The method according to claim 1, wherein the electrolysis is carried out at a temperature of 0° to 30° C., a reactor voltage of 4 to 8 volts and an anode current density of 0.1 to 5 A/dm$^2$.

* * * * *